US007234532B2

(12) United States Patent
Metcalfe et al.

(10) Patent No.: US 7,234,532 B2
(45) Date of Patent: Jun. 26, 2007

(54) EXPANSION APPARATUS AND METHOD

(75) Inventors: Paul David Metcalfe, Banchory (GB); Simon John Harrall, Inverurie (GB); Peter Ellington, Inverurie (GB)

(73) Assignee: Weatherford/Lamb, Inc., Houston, TX (US)

( * ) Notice: Subject to any disclaimer, the term of this patent is extended or adjusted under 35 U.S.C. 154(b) by 317 days.

(21) Appl. No.: 10/886,513

(22) Filed: Jul. 7, 2004

(65) Prior Publication Data

US 2005/0016738 A1 Jan. 27, 2005

(30) Foreign Application Priority Data

Jul. 9, 2003 (GB) ..... 0316048.8

(51) Int. Cl.
*E21B 29/10* (2006.01)

(52) U.S. Cl. ..... 166/384; 166/207; 166/217

(58) Field of Classification Search ..... 166/380, 166/381, 384, 206, 207, 212, 217; 72/61
See application file for complete search history.

(56) References Cited

U.S. PATENT DOCUMENTS 4,580,426 A * 4/1986 Zafred ..... 72/61
6,012,523 A * 1/2000 Campbell et al. ..... 166/381
6,648,075 B2 11/2003 Badrak et al.
6,752,215 B2 6/2004 Maguire et al.
6,820,687 B2 11/2004 Maguire et al.

FOREIGN PATENT DOCUMENTS

| | | |
|---|---|---|
| GB | 2382605 | 6/2003 |
| WO | WO 03/006788 | 1/2003 |
| WO | WO 03/006790 | 1/2003 |

OTHER PUBLICATIONS

GB Search Report dated, Oct. 22, 2003 from GB Application No. 0316048.8.

* cited by examiner

*Primary Examiner*—Jennifer H. Gay
*Assistant Examiner*—Matthew J. Smith
(74) *Attorney, Agent, or Firm*—Patterson & Sheridan, L.L.P.

(57) ABSTRACT

An expansion apparatus for expanding a portion of a tubular comprises at least two expansion members adapted for selective deployment against a wall of a tubular. The expansion apparatus may be controlled to select a first expansion member to be deployed and the apparatus operated to expand a section of the tubular. The deployed expansion member may then be inactivated or retracted, such that the expansion member is no longer deployed against the wall of the tubular or is otherwise rendered inoperative, and a second expansion member can then be deployed and a further section of the tubular expanded.

61 Claims, 9 Drawing Sheets

EXPANSION APPARATUS AND METHOD

CROSS-REFERENCE TO RELATED APPLICATIONS

This application claims benefit of Great Britain patent application serial number GB 0316048.8, filed Jul. 9, 2003, which is herein incorporated by reference.

BACKGROUND OF THE INVENTION

1. Field of the Invention

The present invention relates to an apparatus for the expansion of tubulars, and in particular to an apparatus for expanding tubulars utilised in the oil and gas industry.

2. Description of the Related Art

Recent developments in the fields of exploration and production of hydrocarbons have led to the introduction of technology that enables the expansion of sections of tubing downhole. The tubing may take a number of forms including: casing, liner, sandscreens, packers and hangers. A variety of expansion tools and methods are known, and include the use of expansion mandrels. The expansion mandrel may be in the shape of a cone and may be forced through a section of tubing by the application of an appropriate force. Alternatively, the tubing may be expanded by the use of a rotary expansion tool, which typically comprises a number of expansion rollers which are urged radially outwardly while the tool is rotated within the tubing and advanced axially through the tubing.

Examples of rotary expansion tools and related methods of expanding tubing are disclosed in applicant's patent application WO 00\37766, the disclosure of which is incorporated herein by reference.

One difficulty experienced with known rotary expansion tools is the limited length of tubing that can be expanded by the expansion tool before the tool has to be replaced: this is due to a number of factors, including wear of the rollers and in particular the relatively short life of the roller bearings.

It is an object of at least one embodiment of the present invention to provide a method and apparatus for increasing the operating life of an expansion tool.

SUMMARY OF THE INVENTION

According to a first aspect of the present invention there is provided an expansion apparatus for expanding a portion of a tubular, said apparatus comprising:

at least two expansion members adapted for deployment against a wall of a tubular; and means for selectively deploying the expansion members.

In use, the expansion apparatus may be controlled to select a first expansion member to be deployed and the apparatus operated to expand a section of the tubular. The deployed expansion member may then be inactivated or retracted, such that the expansion member is no longer deployed against the wall of the tubular or is otherwise rendered inoperative, and a second expansion member can then be deployed and a further section of the tubular expanded.

The ability to selectively deploy expansion members at different times may provide the advantage of extending the operational life of the expansion apparatus, by permitting the deployment of the expansion members to be staged such that, for example, a number of expansion members, each with a limited life-span, may be deployed one after the other, such that the life-span of the apparatus is equivalent to the total life-spans of the individual expansion members. Thus, an expansion apparatus in accordance with an embodiment of the present invention may be capable of expanding a greater length of tubular in a single run, compared to that of conventional tools, and therefore reduce the amount of time spent running expansion apparatus into and out of the tubular and reduce the time required to expand the tubular.

The expansion apparatus may be adapted for expansion of a tubular downhole.

Preferably, the expansion members are spaced along a longitudinal axis of the expansion apparatus.

At least one expansion member may be adapted to move radially relative to a body of the expansion apparatus.

In a first embodiment, an expansion member may be adapted to define at least part of an expansion mandrel adapted to be advanced axially through the tubular. The expansion member may be adapted for sliding contact with the tubular or may comprise a roller adapted for rolling contact with the wall of the tubular.

In a second embodiment the expansion member may be adapted to be translated about an axis of the tubular, and the member may comprise a roller adapted for rolling contact with the tubular.

Where an expansion member comprises a roller the axis of rotation of the roller may lie substantially parallel to the longitudinal axis of the expansion apparatus, skew to the longitudinal axis of the expansion apparatus, or in a substantially radial plane of the expansion apparatus.

Preferably, the expansion members are provided as parts of respective expansion member sets, each set comprising a plurality of expansion members.

The expansion members within each set may be circumferentially distributed, preferably on a substantially radial plane. Alternatively, the expansion members within each set may be arranged helically.

Advantageously, there are provided a plurality of separately deployable expansion members spaced along a longitudinal axis of the expansion apparatus.

Preferably, the expansion members are adapted to be sequentially deployed. The sequence of deployment for the expansion members may be top-down; in this mode an upper expansion member is deployed first, followed by an expansion member beneath the previously deployed expansion member. Alternatively, the sequence of deployment of the expansion members may be bottom-up.

Preferably, the expansion apparatus is adapted such that only one expansion member, or one set of expansion members, can be deployed at a time. This reduces the forces or torque required to rotate or otherwise operate the expansion apparatus and further prevents redundant cold working of the tubular, which can lead to unplanned wall thinning of the tubular.

Preferably, expansion members are activated or actuated in response to or relative to one or more parameters relating to wear or anticipated wear of the deployed expansion member. The parameters relating to wear or anticipated wear of the deployed expansion member may be related to a selected one or more of: the length of time the expansion member has been deployed, the number of revolutions the expansion apparatus has completed, the linear distance the expansion apparatus has traveled along the wall of the tubular, or any combination thereof. Where one or more of the expansion members is a roller, the parameters may relate to the wear or anticipated wear of a deployed roller or an element of a deployed roller, such as a bearing.

Alternatively, or in addition, the expansion apparatus may be provided with sensing means for sensing or measuring wear of the deployed expansion member, and the sensing means may be adapted to provide an appropriate output signal when the deployed expansion member has experienced a predetermined level of wear.

The expansion apparatus may further include means for retracting or otherwise inactivating a deployed expansion member.

The means for deploying the expansion members may be one or both of hydraulically or mechanically activated or actuated.

The means for deploying the expansion members may be a common deployment mechanism which controls deployment of the at least two expansion members. Alternatively, the means for deploying the expansion members may comprise a plurality of deployment devices or mechanisms each associated with a respective expansion member or set of expansion members.

Preferably, the expansion apparatus is adapted to be run as part of a tool string, and the tool string may be mounted on any appropriate support such as a string of drill pipe or coiled tubing.

The tool string may comprise a number of expansion apparatus coupled together, and in such a tool string configuration it may be desirable to sequentially deploy the expansion members, that is, in use, only one expansion member, or set of expansion members, within the string is deployed at a time.

The expansion apparatus may further include means for manipulating or controlling manipulation of at least one expansion member, such that a particular individual expansion member can be selected to function as lead member during operation of the expansion apparatus.

According to a second aspect of the present invention there is provided a method of expanding a tubular, the method comprising the steps of:

locating an expansion apparatus within a tubular;

deploying a first expansion member provided on the expansion apparatus and operating the expansion apparatus to expand a portion of the tubular; and then deploying a second expansion member and operating the expansion apparatus to expand a portion of the tubular.

The method may comprise expanding a tubular downhole.

Operation of the expansion apparatus may be achieved, at least in part, by applying one or both of a longitudinal and rotational force to the apparatus.

Preferably, the first expansion member is provided as part of a first set of expansion members, and the second expansion member is provided as part of a second set of expansion members.

The method may include sequentially deploying axially spaced expansion members provided on the expansion apparatus, and the sequential deployment of the expansion members may be performed in a top-down or a bottom-up mode of operation.

The method may include the step of retracting or inactivating a deployed expansion member before another expansion member is deployed.

Preferably, the method comprises deploying only one expansion member, or one set of expansion members, at a time.

Preferably, the method includes monitoring one or more parameters relating to wear or anticipated wear of the expansion members.

Preferably, the method comprises deploying expansion members in response to a change in one or more parameters relating to the wear or anticipated wear of the expansion members. The parameters may relate to wear or anticipated wear of bearings or other elements of the deployed expansion member. The parameters may relate to a selected one or more of: the amount of time the expansion member has been deployed, the number of revolutions the expansion apparatus has completed, the linear distance the expansion apparatus has traveled along the wall of the tubular, or any combination thereof.

Alternatively, the method may comprise measuring or otherwise detecting wear of an element of a deployed expansion member, which may involve use of an appropriate sensor.

The method may include the sensor producing an output signal when the element of the deployed expansion member exhibits a predetermined level of wear.

According to a third aspect of the present invention there is provided an expansion device for expanding a tubular, the expansion device comprising:

a body;

at least one set of expansion members mounted on the body; and means for manipulating at least one expansion member in the set, such that one expansion member of at least two expansion members can be selected to function as lead member during operation of the expansion device.

Applicant has found that during operation of certain expansion devices, and in particular in certain rotary expansion devices and most particularly compliant rotary expansion devices, there is inherently a lead member in a set of expansion members, and this lead member is subjected to the greatest forces in the set and therefore typically experiences the greatest rate of wear. Manipulating an expansion member in the set enables the lead member to be switched during operation of the expansion device. This provides the advantage of being able to equalise the wear experienced and thus extend the operational life of the set of expansion members, and in turn the operational life of the expansion device.

The expansion device may be adapted for expansion of a tubular downhole.

Preferably, the at least one set of expansion members comprise rollers or other rolling elements, but may take any appropriate form including fixed elements.

The means for manipulating the expansion member may take any appropriate form, and may comprise a shaped cam that can be rotated, actuators adapted to act independently on one or more expansion members, or indeed any suitable means for changing which expansion member in the set is the lead member. Where the expansion device is compliant, or the expansion members are otherwise radially movable, the manipulating means may be arranged to vary the radial force acting on one or more expansion members, or to vary the radial positioning of one or more members.

The means for manipulating each member in the set may be adapted to switch the lead member in response to one or more parameters relating to wear, or anticipated wear, of the lead member. The parameters may relate to one or more of: the number of revolutions the expansion device has made, the length of time the expansion members have been deployed, the linear distance the expansion device has traveled along the wall of the tubular, or any combination thereof.

According to a fourth aspect of the present invention there is provided a method of expanding a tubular, the method comprising the steps of:

locating an expansion device having a set of expansion members within a tubular;

operating the expansion device to expand the tubular, and whereby one of the expansion members acts as a lead member; and then manipulating at least one expansion member such that another expansion member acts as a lead member.

The method may include monitoring of one or more parameters of the expansion device in order to determine or predict wear of the lead member. The parameters may relate to a selected one or more of: the length of time the set of expansion members have been deployed, the number of revolutions the expansion device has completed, the linear distance the expansion device has traveled along the wall of the tubular, or any combination thereof.

The method may include locating the expansion device downhole.

BRIEF DESCRIPTION OF THE DRAWINGS

Embodiments of the present invention will now be described, by way of example, with reference to the accompanying drawings, in which.

DETAILED DESCRIPTION

Figure 1:
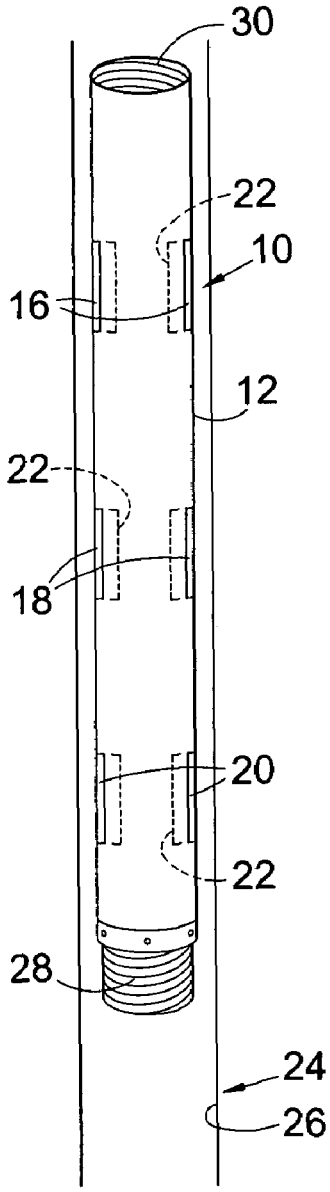
FIG. 1 is a side view of an expansion apparatus in accordance with an embodiment of the present invention, shown located in a bore.

Referring initially to FIG. 1 of the drawings, there is illustrated a side view of an expansion apparatus in accordance with one embodiment of the present invention, indicated generally by reference numeral 10. The expansion apparatus 10 comprises a body 12, which is generally tubular and has a number of sets of expansion members 16, 18, 20 spaced along the length of the apparatus 10. Each individual expansion member 16, 18, 20 is located in a respective body recess 22 from which the expansion member 16, 18, 20 can be radially deployed.

In a first configuration, as illustrated in FIG. 1, the expansion members 16, 18, 20 are retracted such that the expansion apparatus 10 defines a diameter smaller than that of a tubular 24 to be expanded, thus allowing the expansion apparatus 10 to be run into the tubular 24. Once the expansion apparatus 10 is located within the tubular 24, the expansion members 16, 18, 20 can be selectively deployed, as will be described hereinafter, such that a selected set of the expansion members 16, 18, 20 contact an inner wall 26 of the tubular 24, as shown in FIG. 2, in which the upper set 16 has been deployed.

The expansion apparatus 10 is further provided with screw-threaded end connectors 28, 30 enabling the apparatus 10 to be incorporated into a tool string which may comprise one or more expansion apparatus 10 as well as other components or devices.

Figure 2:
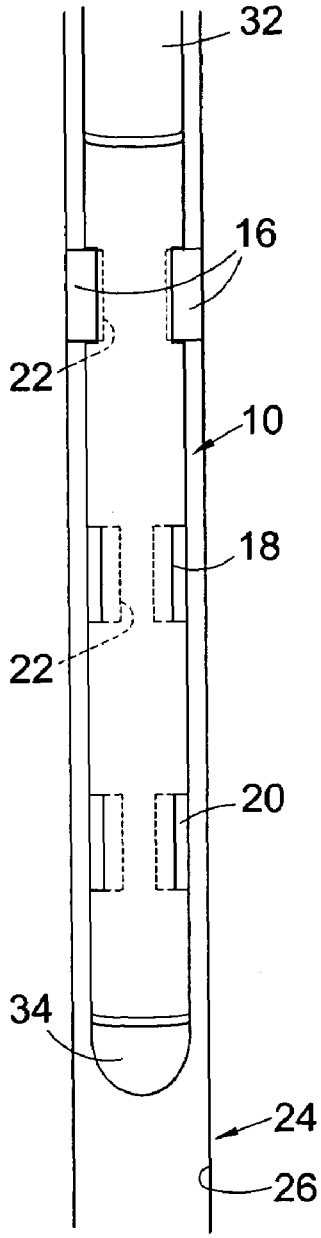
FIG. 2 is a side view of the expansion apparatus of FIG. 1 connected in a tool string.

FIG. 2 illustrates the expansion apparatus 10 in a second configuration, with an uppermost expansion member 16 deployed so as to exert an expansion force against the wall 26 of the tubular 24. The apparatus 10 is illustrated connected at an upper end to drill pipe 32 and terminated at a lower end by a bottom-nose 34.

With the expansion apparatus 10 in the second configuration, as shown in FIG. 2, torque and weight is applied to advance the apparatus 10 along the tubular 24 and to expand a section of the tubular 24.

The expansion apparatus 10 is also adapted to selectively inactivate a deployed expansion member 16, such that the deployed expansion member 16 no longer contacts the wall 26 of the tubular 24. The deployed expansion member 16 may be inactivated by retracting the expansion member 16 into its associated recess 22 by use of a suitably disposed biasing means (not shown), such as a spring or the like. Alternatively, the deployed expansion member 16 can be inactivated so that the expansion member 16 no longer exerts a force on the wall 26 of the tubular 24. Once the deployed expansion member 16 is inactivated, the expansion apparatus 10 can be operated so as to deploy a next expansion member, for example, expansion member 18, and a further section of the tubular 24 can be expanded.

The preferred means for deploying the expansion members 16, 18, 20 is selective and only one set of expansion members 16, 18, 20 can be deployed at a time. This feature ensures that the forces used to rotate and advance the expansion apparatus are kept to a minimum and prevents unnecessary cold working of the tubular.

Therefore, in use, the expansion apparatus 10 can be operated to select and deploy a first set of expansion members 16, and the apparatus 10 then operated to expand a section of the tubular 24. The deployed expansion member 16 can then be inactivated, such that the expansion member 16 is no longer deployed against the wall 26 of the tubular 24, and a second set of expansion members 18 can then be deployed and a further section of the tubular expanded, and so on.

The ability to selectively deploy sets of expansion members at different times can be utilised to extend the operational life of the expansion apparatus, by permitting the deployment of the expansion members at different times.

Figure 3A:
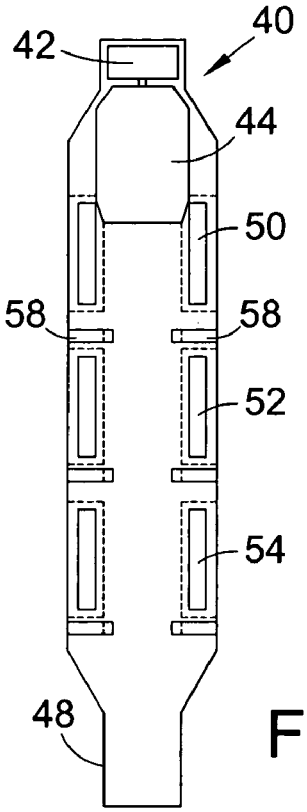
FIGS. 3*a*, 3*b*, 3*c* and 3*d* are schematic illustrations depicting the selective deployment of expansion members in an expansion apparatus in accordance with one embodiment of the present invention.
Figure 3B:
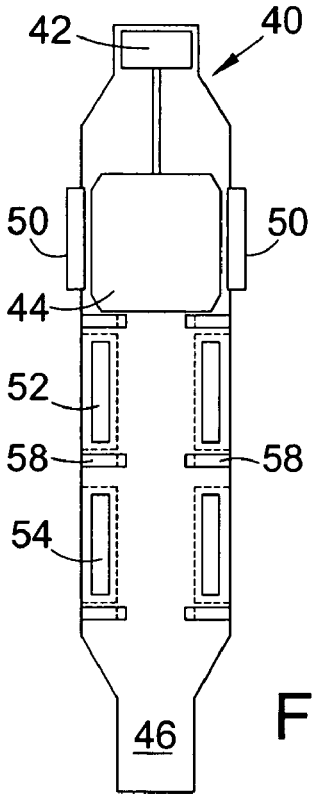
Figure 3C:
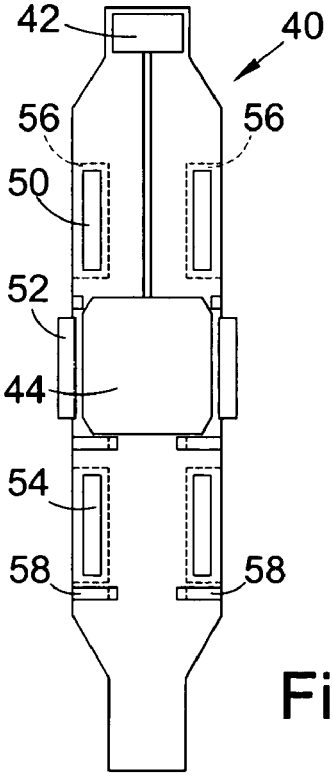
Figure 3D:
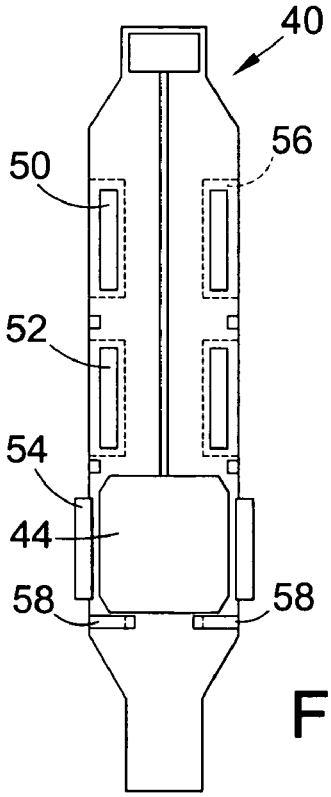
Figures 4A, 4B, 4C, 4D:
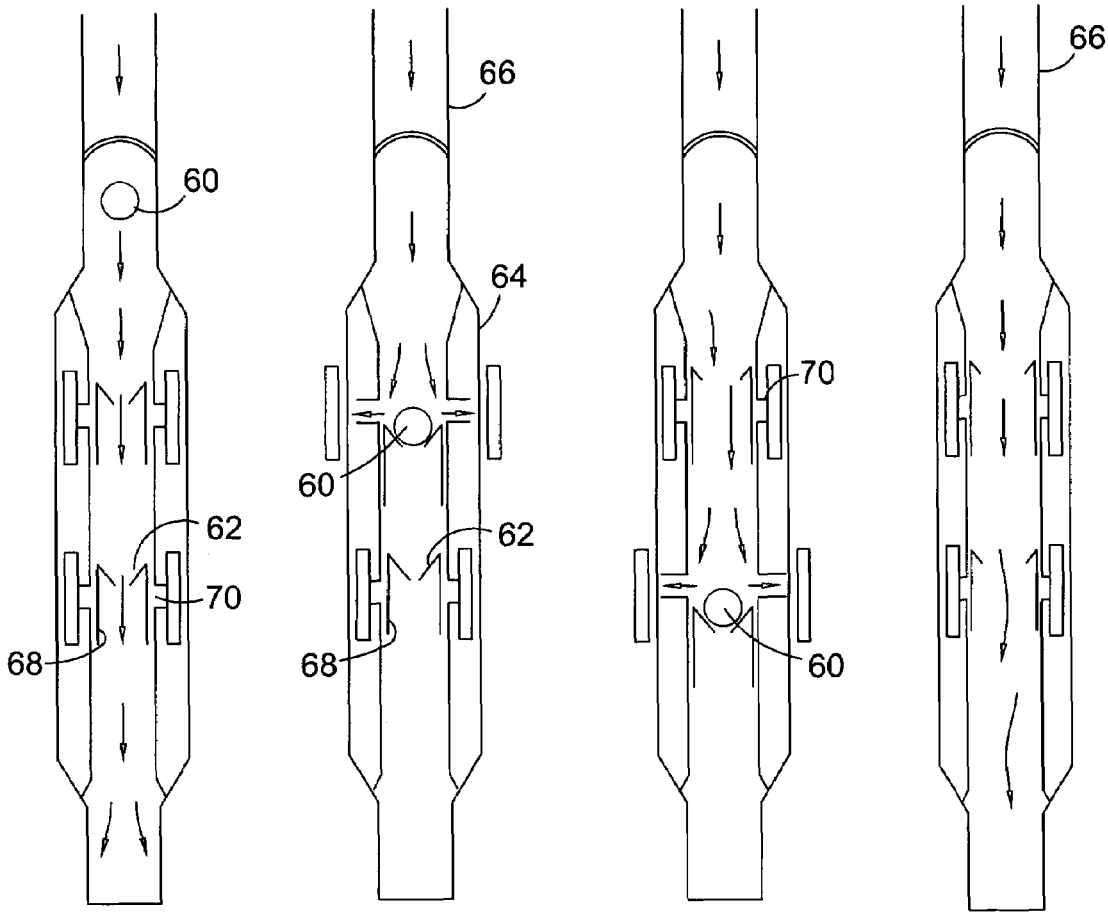
FIGS. 4*a*, 4*b*, 4*c* and 4*d* are schematic illustrations depicting the selective deployment of expansion members in an expansion apparatus in accordance with an alternative embodiment of the present invention.

In addition, the expansion apparatus can be further adapted to sequentially deploy the expansion members in a top down mode of operation, that is, the uppermost expansion member on the expansion apparatus is initially deployed, followed by the expansion member immediately beneath the previously deployed expansion member and so forth until the lowermost expansion member is deployed as depicted in FIGS. 3 and 4.

Deployment of the expansion members 16, 18, 20 of the expansion apparatus 10 can be in response to one or more parameters that relate to wear or predicted wear of the deployed expansion member. The parameters may relate, for example, to the length of time the expansion member has been deployed, the number of revolutions the expansion apparatus has completed or the linear distance the expansion apparatus has advanced through the tubular. These parameters can be monitored and displayed at the surface so as to allow an operator to decide when to inactivate a deployed expansion member and deploy the next expansion member.

Alternatively, the expansion apparatus can be provided with a sensor that provides an indication of actual wear of the deployed expansion member. The sensor produces a signal which is relayed to surface to indicate the condition of the expansion member to the operator, thereby allowing the operator to decide when to change from one expansion member to another.

Reference is now made to FIG. 3 of the drawings, which illustrates cross-sectional views of an expansion apparatus 40 in accordance with an embodiment of the present invention. The expansion apparatus 40 is provided with an actuating device 42 for selectively deploying expansion members 50, 52, 54. The actuating device 42 comprises a hydraulically driven piston that drives an actuating member 44 through a hollow centre 46 of a body 48 of the expansion apparatus 40. The actuating member 44 is utilised to deploy the expansion members 50, 52, 54 by moving the expansion members outwardly from recesses 56 in which the expansion members 50, 52, 54 are located.

The actuating device 42 can be operated by fluid pressure supplied to the actuating device 42 through the hollow centre 46 of the expansion apparatus 40. The fluid pressure may be applied from surface via a supporting string.

The expansion apparatus 40 is further provided with multiple sets of locating fingers or stops 58 that ensure that the actuating member 44 stops in a desired position. Fluid pressure of a pre-determined level can be exerted on the actuating device 42, enabling movement of the actuating member 44 through the hollow centre 46 of the apparatus 40 until the actuating member 44 comes to rest against a set of fingers 58.

The locating fingers 58 are provided with frangible portions which are designed to shear or break when a specific overpressure force is applied. Therefore, to disengage or inactivate a deployed expansion member an overpressure force is applied to the actuating device 42 to shear the respective locating fingers 58, and allow the actuating member 44 to move to the next set of locating fingers 58 under normal fluid pressure.

Referring specifically to FIGS. 3*a* and 3*b* of the drawings, once the actuating member 44 shears the locating fingers 58 and moves pass the deployed set of expansion members 50, the expansion members 50 are disengaged and a spring urges the expansion members 50 back into their respective recesses 56. As the actuating member 44 then continues to travel along the expansion apparatus 40 it engages and deploys the next set of expansion members 52 located along the expansion apparatus 40.

In an alternative embodiment, as shown in FIG. 4, the means for deploying the expansion member comprises a ball-drop arrangement, wherein a ball 60 is pumped down a supporting drill pipe 66 from surface into an expansion apparatus 64. The ball 60 is forced into sealing engagement with a sealing member 62, thereby isolating the expansion apparatus 64 beneath the sealing member 62 from fluid pressure in the drill pipe 66. The fluid pressure in the drill pipe 66 applies a differential pressure force across the ball 60 and the sealing member 62 to move the sealing member 62, and a sleeve 68 coupled to the sealing member 62. Movement of the sleeve 68 opens ports 70 allowing fluid pressure to act upon and extend the respective expansion members.

The sealing member 62 is arranged such that portions of the sealing member fracture or deform at a pre-set overpressure thereby allowing the ball 60 to pass from a first sealing member to a second sealing member and therefore allow for the selective deployment of a first and then a subsequent expansion member.

Figure 5:
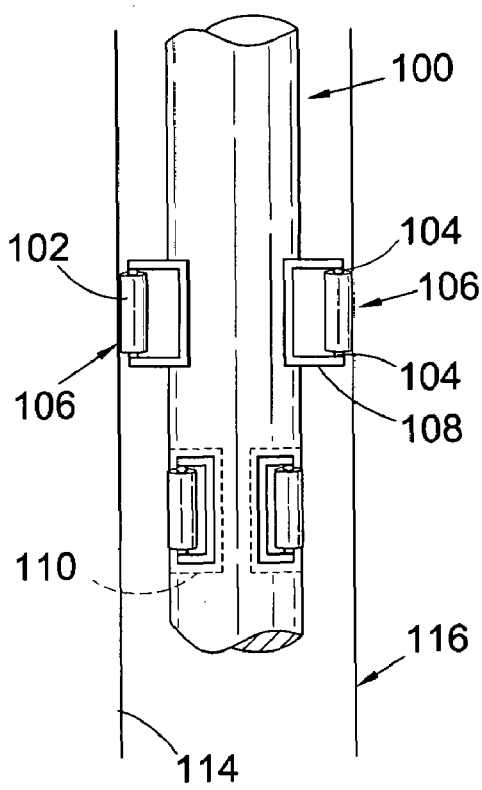
FIG. 5 is a schematic illustration showing an expansion device incorporating rollers mounted in respective moveable frames.

Reference is now made to FIG. 5 of the drawings, which illustrates an embodiment of the present invention wherein an expansion member 106 of an expansion apparatus 100 comprises a roller 102 mounted within a radially moveable frame 108. At each end of the roller 102 there is provided a bearing 104 for supporting the roller 102 in rolling contact with a wall 114 of a tubular 116 when the expansion member 106 is deployed from respective recesses 110.

Figure 6A:
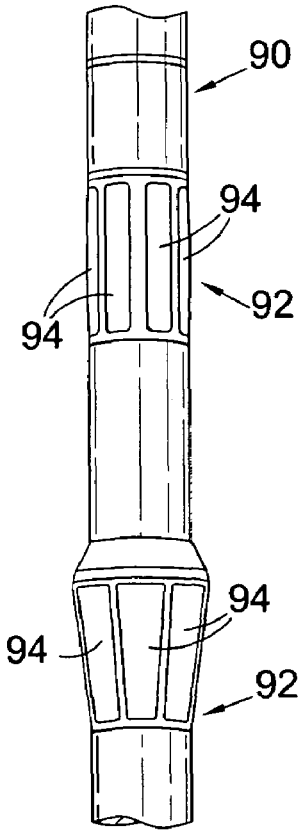
FIG. 6*a* illustrates an expansion device including an expansion member forming a cone shaped mandrel when deployed.

Reference is now made to FIG. 6*a* of the drawings, which illustrates an expansion apparatus 90 comprising expansion members 92 that, when deployed, form a cone-shaped mandrel. Each expansion member 92 comprises of a plurality of moveable expansion elements 94 that can be operated simultaneously to transform the expansion member from a retracted first configuration, as depicted at the upper end of the expansion apparatus 90, to an expanded second configuration, wherein the expansion member takes the form of a cone-shaped mandrel, as depicted at the lower end of the expansion apparatus 90. The cone-shaped mandrel is configured such that the expansion member 92 comes into sliding contact with a wall of a tubular so as to expand the tubular.

Figure 6B:
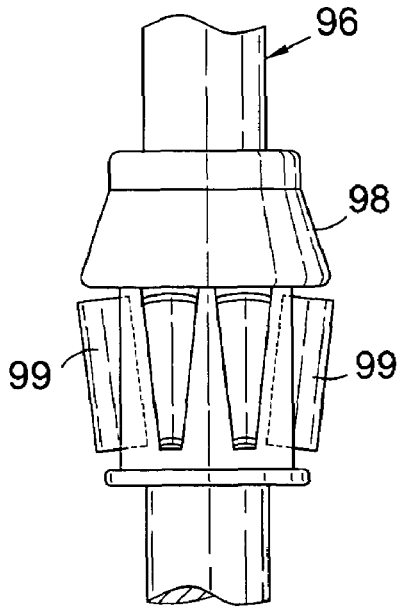
FIG. 6*b* illustrates an expansion device including a cone shaped mandrel with rollers incorporated therein.

Alternatively, an expansion apparatus can be configured as illustrated in FIG. 6*b*, wherein an expansion apparatus 96 is provided with a cone-shaped section 98 having a plurality of rollers 99 provided therein. The rollers 99 are adapted to be radially deployed from the cone-shaped section 98 of the expansion apparatus 96.

Figure 7A:
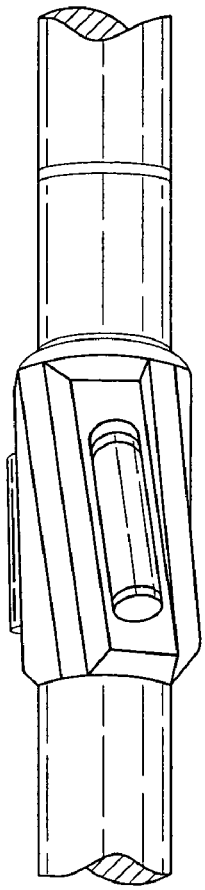
FIGS. 7*a* to 7*c* illustrate various configurations of rollers mounted in expansion apparatus.
Figure 7B:
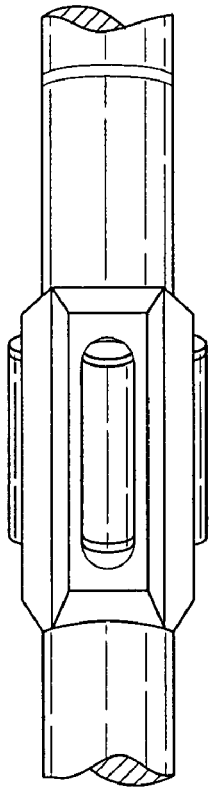
Figure 7C:
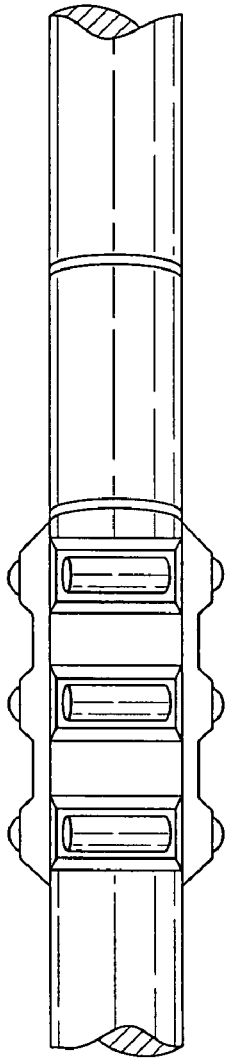

There are also a number of alternative arrangements in which rollers can be configured in an expansion apparatus, some of which are illustrated in FIGS. 7*a* to 7*c* of the drawings. FIG. 7*a* shows rollers arranged with their axes of rotation skew to the longitudinal axis of the expansion apparatus; FIG. 7*b* shows rollers with their axes of rotation parallel to the longitudinal axis of the expansion apparatus; and FIG. 7*c* shows rollers with their axes of rotation on a radial plane of the expansion apparatus.

Figure 8A:
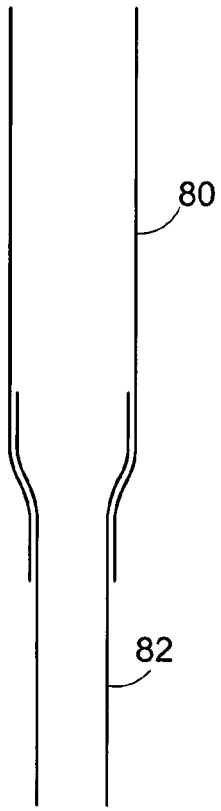
FIGS. 8*a*, 8*b*, 8*c* and 8*d* are schematic illustrations depicting expansion of a tubular.
Figure 8B:
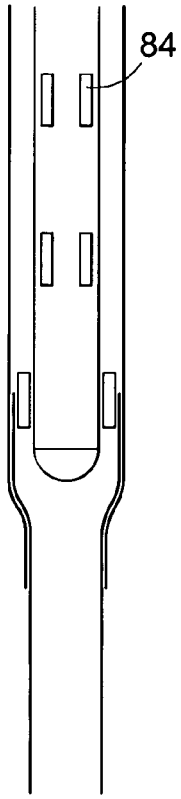
Figure 8C:
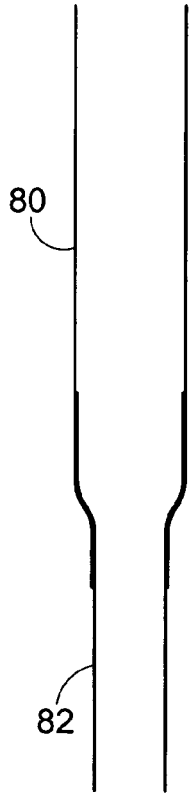
Figure 8D:
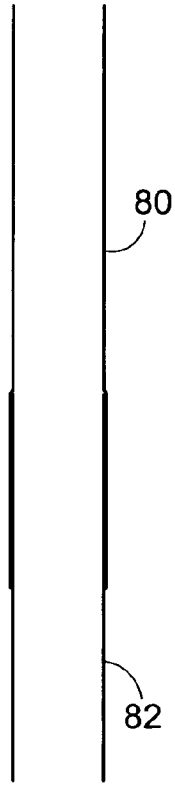

Reference is now made to FIGS. 8*a* to 8*d* of the drawings, which illustrates the process of expanding a section of a tubular. FIG. 8*a* illustrates the lower end of a first tubular 80 within which is located an upper end of a second tubular 82 of slightly smaller diameter. The lower end of the first tubular 82 may have a reduced diameter so as to provide a temporary hanger from which the second tubular 82 can be suspended. The second tubular 82 may be provided with an upper portion that is shaped to have an increased diameter complementary to that of the reduced diameter portion of the first tubular 80. Once the tubulars 80, 82 are located together, an expansion apparatus 84 is positioned at the overlapping portion of the two tubulars. A first set of expansion members is then deployed so as to exert an expansion force on the inner second tubular 82. Torque and weight is then applied to the expansion apparatus 84 to advance the expansion apparatus 84 through the tubulars 80, 82 thereby expanding the inner tubular 82 by way of compressive plastic deformation and the outer tubular 80 by contact with the expanding inner tubular 82. The expansion apparatus can thus be used to join the two tubulars 80, 82 together as depicted in FIG. 8*c* and can further be used to expand the overlapping portion of the tubulars 80, 82 so that the tubulars 80, 82 have a bore of unitary diameter, as depicted in FIG. 8*d*.

Reference is now made to FIGS. 9*a* to 9*d* of the drawings, which illustrate an expansion device 120 for expanding a tubular. The expansion device 120 comprises a body 122 and expansion members 126, 128 forming part of a set of expansion members mounted on the body 122 of the expansion device 120. In addition, the expansion device 120 is provided with a rotatable cam 130 for manipulating the expansion members 126, 128, the cam 130 being designed such that one of the expansion members 126, 128 can be selected to function as lead member during operation of the expansion device 120.

Figure 9A:
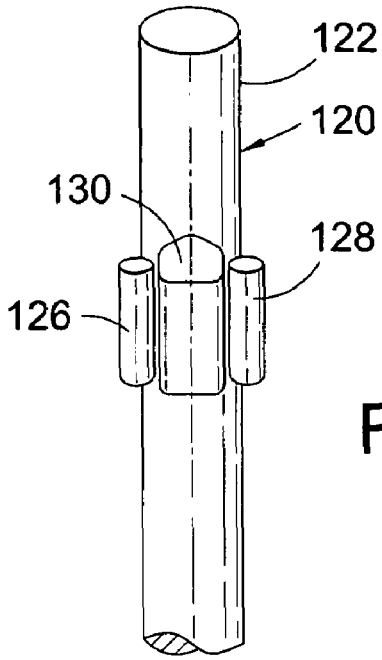
FIGS. 9*a* to 9*d* are schematic illustrations showing the application of different forces to moveable members forming an expansion member in accordance with an embodiment of the present invention.
Figure 9B:
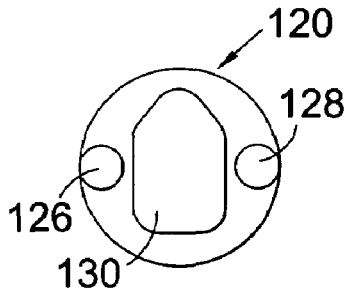
Figure 9C:
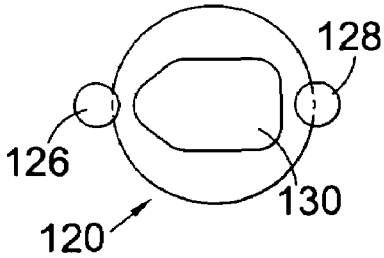
Figure 9D:
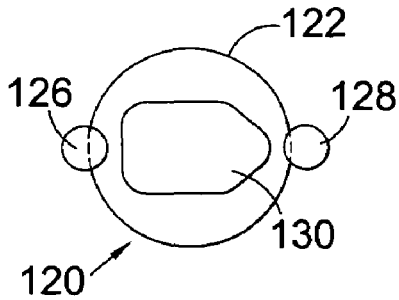

The cam 130 may be hydraulically or mechanically driven, from a neutral position as depicted in FIGS. 9*b*, to one of two active positions so as apply a different radial force to the expansion members 126, 128, as illustrated in FIGS. 9*c* and 9*d* of the drawings. FIG. 9*c* depicts the rotatable cam 130 positioned such that the expansion member 126 protrudes further from the device body 122 than the other expansion member 128 and will therefore function as lead member if operated to expand a tubular in this configuration. FIG. 9*d* illustrates the configuration of the rotatable cam 130 to allow the other expansion member 128 to function as lead member.

It has been found that the lead member in an expansion member is subjected to the greatest forces and therefore typically wears out first. Therefore, the ability to change which expansion member is the lead member allows the wear to be more evenly distributed amongst the expansion members, rather than having a single expansion member exposed to the extreme forces experienced by the lead member.

Various modifications may be made to the foregoing examples without departing from the scope of the present invention. For example, the expansion apparatus may be located at the end of a coiled tubing and/or may be connected to a wire line or slick line in order to provide electrically power to the expansion apparatus. The expansion members may be electrically activated or actuated, and can be helically distributed around the circumference of the expansion apparatus. In addition, the expansion members may be operated in a bottom-up mode of operation.

Figure 10A:
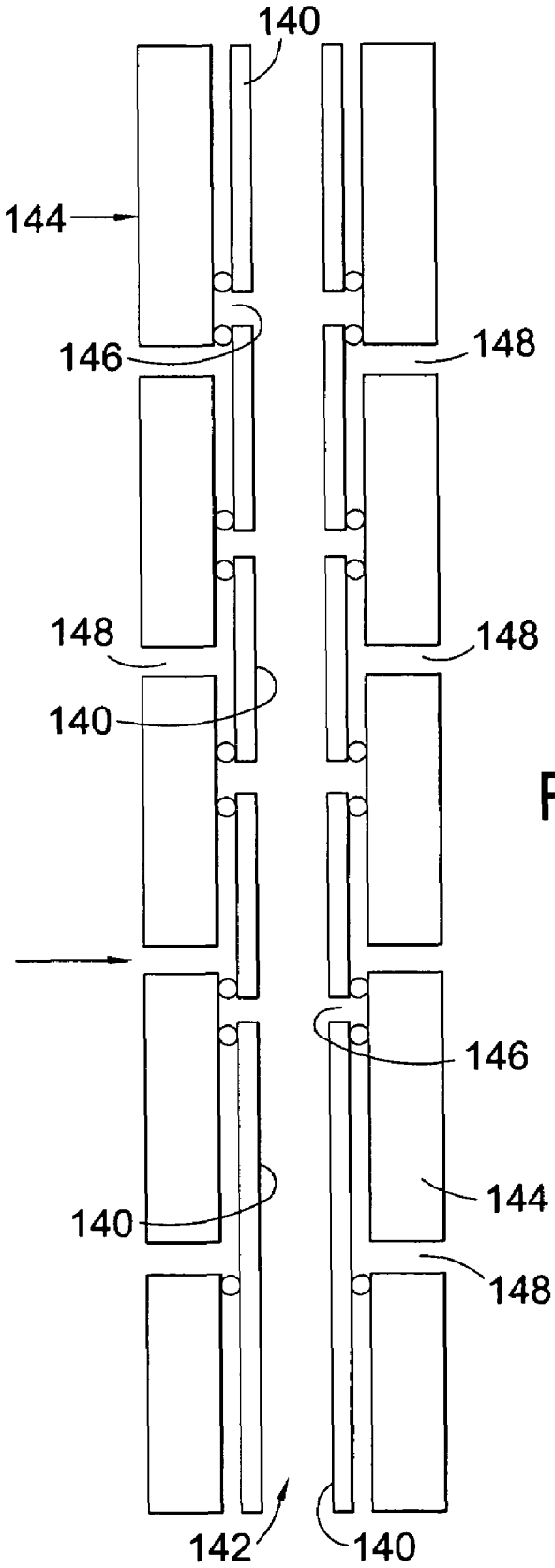
FIGS. 10*a* to 10*g* are schematic illustrations showing alternative arrangement for the selective deployment of expansion members in an expansion apparatus in accordance with a further embodiment of the present invention.

As will be appreciated by persons skilled in the art, there are a number of arrangements possible for selectively deploying the expansion members. For instance, as depicted in FIG. 10*a* of the drawings, the deployment means may comprise a multi-positionable moveable sleeve 140 located within a hollow centre 142 of an expansion apparatus body 144.

The moveable sleeve 140 is provided with a plurality of apertures 146 which are spaced along the length of the sleeve 140. The apertures 146 are arranged such that movement of the sleeve 140 through the body 144 allows a single aperture 146, or set of apertures, that is a number of apertures 146 arranged on the same radial plane, to align with a respective single port 148, or set of ports, provided in the body 144, as illustrated in FIGS. 10*b* to 10*f* of the drawings and as will subsequently be described. Each port 148 is associated with a respective fluid-pressure activated expansion member (not shown).

Providing a moveable sleeve 140 with apertures 146 located relative to the expansion member actuating ports 148 in this manner enables a series of expansion members to be brought into fluid communication with, or isolated from, pressurised fluid contained within the sleeve 140, thereby allowing the expansion members to be selectively activated and deactivated as the moveable sleeve 140 is translated through the body.

The moveable sleeve 140 is in sliding, sealing contact with an inner surface 150 of the body 144 and is provided with a series of spaced stops, positioned to ensure alignment of an aperture 146 with a respective port 148, so as to deploy the associated expansion member.

Figure 10G:
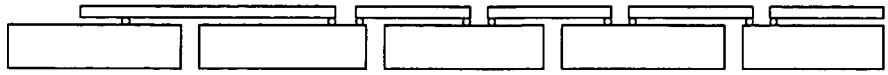
Figure 10F:
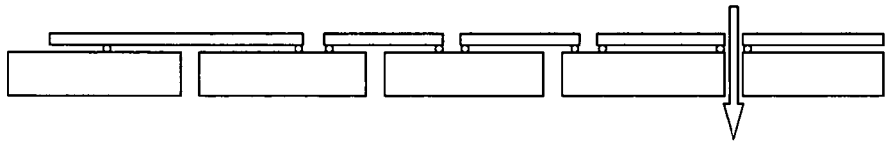
Figure 10E:
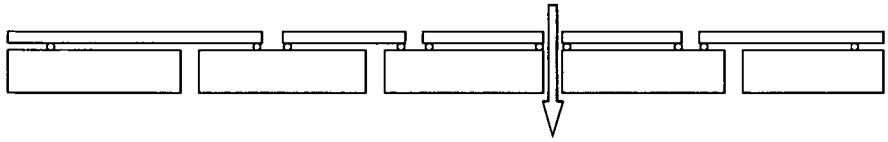
Figure 10D:
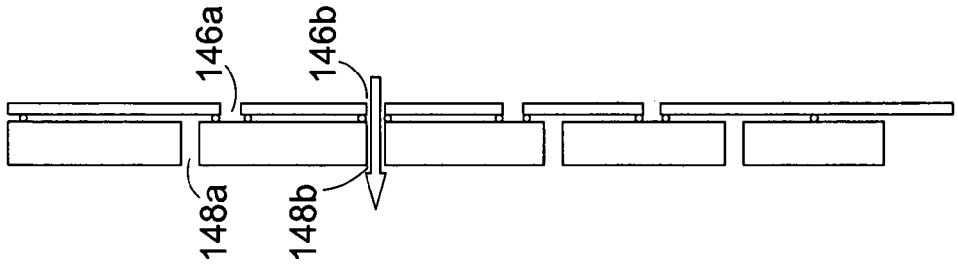
Figure 10C:
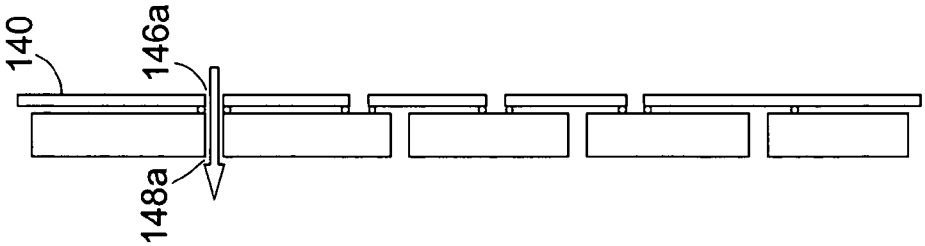
Figure 10B:
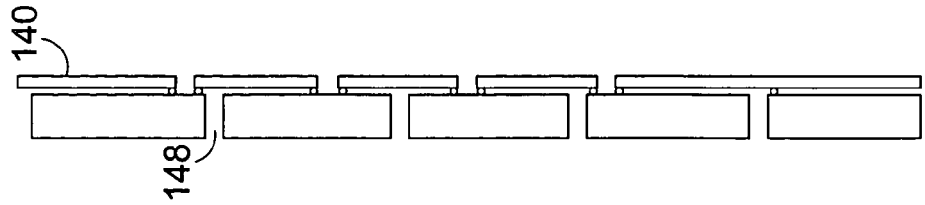

In use, the moveable sleeve 140 is initially located in a first position, as depicted in FIG. 10*b* of the drawings, wherein all the ports 148, and thus the expansion members, are isolated from the fluid pressure within the sleeve 140. The expansion apparatus 144 may be run into a tubular to be expanded in this configuration. Once the expansion apparatus is in position, the moveable sleeve 140 can be operated so as to be moved to a second position to align the uppermost aperture 146*a* with the uppermost port 148*a*, as depicted in FIG. 10*c* of the drawings, thereby allowing the deployment of a first expansion member. The expansion apparatus is then operated to expand a section of the tubular. When required, typically when the first expansion member is considered to be nearing the end of its operational life, the moveable sleeve 140 is moved to misalign the uppermost aperture 146*a* and port 148*a*, to isolate the first expansion member, and align the next aperture 146*b* and port 148*b*, to deploy a second expansion member, as depicted in FIG. 10*d*. This process is repeated so as to selectively deploy subsequent expansion members, as depicted in FIGS. 10*e* to 10*g* of the drawings.

The sleeve 140 may be moved through the body using any appropriate tool or device, and may be activated by, for example, dropping balls or darts with shear devices, electric solenoids and the like.

The invention claimed is:

1. An expansion apparatus for expanding a portion of a tubular, said apparatus comprising:

at least two expansion members adapted for deployment against a wall of a tubular; and means for selectively deploying the expansion members, wherein expansion members are deployed in response to at least one parameter relating to wear of a previously deployed expansion member.

2. The expansion apparatus of claim 1, wherein the expansion apparatus is adapted for expansion of a tubular downhole.

3. The expansion apparatus of claim 1, wherein the expansion members are spaced along a longitudinal axis of the expansion apparatus.

4. The expansion apparatus of claim 1, wherein at least one expansion member is adapted to move radially relative to a body of the expansion apparatus.

5. The expansion apparatus of claim 1, wherein an expansion member is adapted to define at least part of an expansion mandrel adapted to be advanced axially through a tubular.

6. The expansion apparatus of claim 5, wherein at least one expansion member is adapted for sliding contact with a tubular.

7. The expansion apparatus of claim 5, wherein at least one expansion member comprises a roller adapted for rolling contact with a wall of a tubular.

8. The expansion apparatus of claim 1, wherein at least one expansion member is adapted to be translated about an axis of a tubular to be expanded, and the member comprises a roller adapted for rolling contact with a tubular.

9. The expansion apparatus of claim 1, wherein at least one expansion member comprises a roller adapted for rolling contact with a wall of a tubular and the axis of rotation of the roller is one of: substantially parallel to a longitudinal axis of the expansion apparatus, skew to a longitudinal axis of the expansion apparatus, and in a substantially radial plane of the expansion apparatus.

10. The expansion apparatus of claim 1, wherein each expansion members comprises a part of a respective expansion member set, each set comprising a plurality of expansion members.

11. The expansion apparatus of claim 10, wherein the expansion members within each set are circumferentially spaced.

12. The expansion apparatus of claim 10, wherein the expansion members within each set are distributed on a substantially radial plane.

13. The expansion apparatus claim 10, wherein the expansion members within each set are arranged helically.

14. The expansion apparatus of claim 1, wherein there are provided a plurality of separately deployable expansion members spaced along a longitudinal axis of the expansion apparatus.

15. The expansion apparatus of claim 1, wherein the expansion members are adapted to be sequentially deployed.

16. The expansion apparatus as claimed in claim 15, wherein the sequence of deployment for the expansion members is in a top-down order.

17. The expansion apparatus as claimed in claim 15, wherein the sequence of deployment of the expansion members is bottom-up.

18. The expansion apparatus of claim 1, wherein the expansion apparatus is adapted such that only one expansion member can be deployed at a time.

19. The expansion apparatus as claimed in claim 1, wherein the parameter relating to wear of the deployed expansion member is related to a selected at least one of: the length of time the expansion member has been deployed, the number of revolutions the expansion apparatus has completed, and the linear distance the expansion apparatus has traveled along the wall of the tubular.

20. The expansion apparatus of claim 1, wherein the parameter relates to the wear of an element of a deployed expansion roller.

21. The expansion apparatus of claim 1, wherein the expansion apparatus is provided with sensing means for detecting wear of a deployed expansion member.

22. The expansion apparatus as claimed in claim 21, wherein the sensing means is adapted to provide an appropriate output signal when the deployed expansion member has experienced a predetermined level of wear.

23. The expansion apparatus of claim 1, wherein the expansion apparatus is provided with means for inactivating a deployed expansion member.

24. The expansion apparatus of claim 1, wherein the means for deploying the expansion members is at least one of hydraulically and mechanically activated.

25. The expansion apparatus of claim 1, wherein the means for deploying the expansion members is a common deployment mechanism.

26. The expansion apparatus of claim 1, wherein the means for deploying the expansion members comprises a plurality of deployment devices each associated with a respective expansion member.

27. The expansion apparatus as claimed claim 1, wherein the expansion apparatus is adapted to be run as part of a tool string.

28. The expansion apparatus as claimed in claim 27, wherein the tool string comprises a number of expansion apparatus coupled together.

29. The expansion apparatus of claim 1, wherein the expansion apparatus includes means for manipulating at least one expansion member, such that a particular individual expansion member can be selected to function as lead member during operation of the expansion apparatus.

30. A method of expanding a tubular, the method comprising the steps of:

locating an expansion apparatus within a tubular;

deploying a first expansion member provided on the expansion apparatus and translating the expansion apparatus in a first axial direction to expand a portion of the tubular; and then deploying a second expansion member and translating the expansion apparatus in the first axial direction to expand a portion of the tubular.

31. The method as claimed in claim 30, wherein the method comprises expanding a tubular downhole.

32. The method of claim 30, wherein operation of the expansion apparatus is achieved by applying at least one of a longitudinal and rotational force to the apparatus.

33. The method of claim 30, wherein the first expansion member is provided as part of a first set of expansion members, and the second expansion member is provided as part of a second set of expansion members.

34. The method of claim 30, wherein the method includes sequentially deploying axially spaced expansion members provided on the expansion apparatus.

35. The method as claimed in claim 34, wherein the sequential deployment of the expansion members is performed top-down.

36. The method of claim 30, wherein the method includes the step of inactivating a deployed expansion member before another expansion member is deployed.

37. The method of claim 30, wherein the method comprises deploying only one expansion member at a time.

38. The method of claim 30, wherein the method includes monitoring at least one parameter relating to wear of the expansion members.

39. The method of claim 38, wherein the parameters relate to a selected at least one of: the length of time the expansion member has been deployed, the number of revolutions the expansion apparatus has completed, and the linear distance the expansion apparatus has traveled along the wall of the tubular.

40. The method of claim 30, wherein the method comprises determining wear of an element of a deployed expansion member.

41. The method as claimed in claim 40, wherein the method includes producing an expansion member deployment signal when the element of the deployed expansion member exhibits a predetermined level of wear.

42. A method of expanding a tubular, comprising:

locating an expansion apparatus within a tubular;

deploying a first expansion member provided on the expansion apparatus and operating the expansion apparatus to expand a portion of the tubular; and then deploying a second expansion member and operating the expansion apparatus to expand a portion of the tubular, wherein the method comprises deploying expansion members in response to a change in at least one parameter relating to wear of the expansion members.

43. An expansion device for expanding a tubular, the expansion device comprising:

a body;

at least one set of expansion members mounted on the body; and means for manipulating at least one expansion member in the set, such that one expansion member of at least two expansion members can be selected to function as lead member during operation of the expansion device, wherein the at least two expansion members are circumferentially spaced from one another around the body at one longitudinal location along the body.

44. The expansion device as claimed in claim 43, wherein the expansion device is adapted for expansion of a tubular downhole.

45. The expansion device of claim 43, wherein the at least one set of expansion members comprise at least one of rolling elements and fixed elements.

46. The expansion device of claim 43, wherein the means for manipulating the expansion member is selected from at least one of a shaped cam that can be rotated and actuators adapted to act independently on at least one expansion member.

47. The expansion device of claim 43, wherein the manipulating means is arranged to vary the radial force acting on at least one expansion member.

48. The expansion device of claim 43, wherein the manipulating means is arranged to vary the radial positioning of at least one expansion member.

49. The expansion device of claim 43, wherein the means for manipulating each member in the set is adapted to switch the lead member in response to at least one parameter relating to wear of the lead member.

50. The expansion device as claimed in claim 49, wherein the parameter relates to at least one of: the number of revolutions the expansion device has made, the length of time the expansion member has been deployed, and the linear distance the expansion device has traveled along the wall of the tubular.

51. A method of expanding a tubular, the method comprising the steps of:

locating an expansion device having a set of expansion members within a tubular, wherein the expansion members are circumferentially spaced from one another around the device at one longitudinal location along the device;

operating the expansion device to expand the tubular, whereby one of the expansion members acts as a lead member; and manipulating at least one expansion member such that another expansion member acts as a lead member.

52. The method as claimed in claim 51, wherein the method includes monitoring at least one parameter of the expansion device in order to determine wear of the lead member.

53. The method as claimed in claim 52 wherein the at least one parameter relates to at least one of: the length of time the set of expansion members have been deployed, the number of revolutions the expansion device has completed, and the linear distance the expansion device has traveled along the wall of the tubular.

54. The method of claim 51 wherein the method includes locating the expansion device downhole.

55. An expansion device for expanding a tubular, the expansion device comprising:

a body; and at least one set of expansion members mounted on the body, at least one expansion member in the set being adapted for manipulation such that one expansion member of at least two expansion members can be selected to function as a lead member during operation of the expansion device, wherein the at least two expansion members are circumferentially spaced from one another around the body at one longitudinal location along the body.

56. An expansion apparatus for expanding a portion of tubing, comprising:

first and second expansion members adapted for sequential deployment against a wall of the tubing, wherein the expansion members are selectively deployable independently of one another; and an internal sliding sleeve moveable between a first position that selectively deploys the first expansion member and a second position that deactivates the first expansion member.

57. The expansion apparatus of claim 56, wherein movement of the sleeve selectively opens and closes fluid passages to at least one of the expansion members.

58. The expansion apparatus of claim 56, wherein the second position deploys the second expansion member.

59. The expansion apparatus of claim 56, wherein the sleeve includes a ball seat and the sleeve is moveable in response to a pressure differential across the ball seat.

60. The expansion apparatus of claim 56, wherein the first position aligns a first aperture of the sleeve with a first port associated with the first expansion member and misaligns a second aperture of the sleeve with a second port associated with the second expansion member.

61. The expansion apparatus of claim 60, wherein the second position aligns the second aperture of the sleeve with the second port and misaligns the first aperture of the sleeve with the first port.

* * * * *